US009422854B2

(12) United States Patent
Maeda

(10) Patent No.: US 9,422,854 B2
(45) Date of Patent: Aug. 23, 2016

(54) EXHAUST GAS EVACUATION SYSTEM STRUCTURE FOR INTERNAL COMBUSTION ENGINE

(75) Inventor: Osamu Maeda, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 14/357,850

(22) PCT Filed: Dec. 6, 2011

(86) PCT No.: PCT/JP2011/078166

§ 371 (c)(1),
(2), (4) Date: May 13, 2014

(87) PCT Pub. No.: WO2013/084293

PCT Pub. Date: Jun. 13, 2013

(65) Prior Publication Data

US 2014/0305108 A1 Oct. 16, 2014

(51) Int. Cl.
*F01N 13/10* (2010.01)
*F01N 13/18* (2010.01)

(52) U.S. Cl.
CPC ..... *F01N 13/102* (2013.01); *F01N 13/10* (2013.01); *F01N 13/1805* (2013.01); *F01N 2260/20* (2013.01)

(58) Field of Classification Search
CPC ... F01N 13/10; F01N 13/102; F01N 13/1805; F01N 2260/20
USPC ..... 60/322, 323
See application file for complete search history.

(56) References Cited

U.S. PATENT DOCUMENTS

| | | | | |
|---|---|---|---|---|
| 6,318,734 | B1 * | 11/2001 | Boskamp | 277/598 |
| 2007/0252315 | A1 | 11/2007 | Mishima | |
| 2008/0265524 | A1 * | 10/2008 | Mori | 277/595 |
| 2010/0025984 | A1 * | 2/2010 | Kullen et al. | 285/189 |

FOREIGN PATENT DOCUMENTS

| | | |
|---|---|---|
| DE | 10 2009 018 277 A1 | 11/2010 |
| JP | 56-169417 | 12/1981 |
| JP | 61-65231 | 5/1986 |
| JP | 8-177476 | 7/1996 |
| JP | 2006-274988 | 10/2006 |

OTHER PUBLICATIONS

International Search Report issued Feb. 21, 2012, in PCT/JP11/078166 filed Dec. 6, 2011.

* cited by examiner

*Primary Examiner* — Audrey K Bradley
(74) *Attorney, Agent, or Firm* — Oblon, McClelland, Maier & Neustadt, L.L.P

(57) ABSTRACT

An exhaust system structure for an internal combustion engine is provided with an exhaust manifold and a plate-like heat shielding member. The exhaust manifold has branch pipes and flanges formed at the distal ends of the branch pipes. The heat shielding member covers the exhaust manifold and suppresses the occurrence of heat damage caused by the exhaust manifold. The basal portion of the heat shielding member and the flanges are fastened to the cylinder head by common fastening members.

5 Claims, 2 Drawing Sheets

EXHAUST GAS EVACUATION SYSTEM STRUCTURE FOR INTERNAL COMBUSTION ENGINE

TECHNICAL FIELD

The present invention relates to an exhaust system structure for an internal combustion engine.

BACKGROUND ART

As described in Patent Document 1, for example, an exhaust manifold is mounted in the exhaust system of an internal combustion engine. The exhaust manifold includes branch pipes, which are connected to exhaust ports of the cylinders, and a collecting pipe into which the branch pipes converge. A flange is formed on the distal portion of each one of the branch pipes. The exhaust manifold is fastened to the cylinder head with bolts engaged with bolt holes formed in the flanges and the cylinder head. The exhaust manifold is formed of cast steel.

The exhaust system of the engine includes a plate-like heat shielding member, which is a heat insulator for covering the exhaust manifold to suppress the occurrence of heat damage caused by the exhaust manifold. Patent Document 1 discloses a configuration in which the heat shielding member is fastened to the exhaust manifold by passing bolts through bolt holes formed in the surfaces of the branch pipes and the surface of the collecting pipe of the exhaust manifold. Patent Document 2 describes a configuration in which the heat shielding member is fastened to the exhaust manifold by means of bolts engaged with bolt holes formed in the flanges of the intake manifold. The bolt holes are separate from bolt holes employed to fasten the intake manifold to the cylinder head.

PRIOR ART DOCUMENTS

Patent Documents

Patent Document 1: Japanese Laid-Open Utility Model Publication No. 61-65231

Patent Document 2: Japanese Laid-Open Patent Publication No. 8-177476

SUMMARY OF THE INVENTION

Problems that the Invention is to Solve

In a conventional exhaust system structure for an internal combustion engine, an exhaust manifold must be fastened to the cylinder head and, separately, a heat shielding member must be fastened to the exhaust manifold. In other words, it is necessary to employ a step of forming bolt holes used to fasten the heat shielding member to the exhaust manifold and a step of fastening the heat shielding member to the exhaust manifold. The structure thus has room for improvement in simplifying the configuration for fastening the exhaust manifold and the heat shielding member. Further, since the exhaust manifold is formed of material hard to cut, such as cast steel, machining for forming the bolt holes is difficult.

Accordingly, it is an objective of the present invention to provide an exhaust system structure for an internal combustion engine that simplifies the configuration for fastening an exhaust manifold and a heat shielding member.

Means for Solving the Problems

Means for achieving the above objective and advantages thereof will now be discussed.

To achieve the foregoing objective and in accordance with one aspect of the present invention, an exhaust system structure for an internal combustion engine is provided. The structure includes an exhaust manifold and a plate-like heat shielding member. The exhaust manifold includes a plurality of branch pipes and flanges each formed on a distal portion of one of the branch pipes. The plate-like heat shielding member covers the exhaust manifold to suppress occurrence of heat damage caused by the exhaust manifold. A basal portion of the heat shielding member and the flanges are fastened to a cylinder head of the engine by a common fastening member.

In this configuration, compared with the conventional configuration in which the flanges of the exhaust manifold are fastened to the cylinder head using fastening members and the heat shielding member is fastened to the exhaust manifold using fastening members separate from the aforementioned fastening members, the exhaust manifold and the heat shielding member are fastened using a smaller number of fastening members. The number of the employed fastening members is thus decreased. The configuration also makes it unnecessary for the exhaust manifold to have holes specifically formed to fasten the fastening members to the exhaust manifold. The configuration for fastening the exhaust manifold and the heat shielding member is thus simplified.

In this case, the flanges of the branch pipes are preferably separate from one another. The fastening member preferably includes bolts passed through bolt holes formed in the basal portion of the heat shielding member, the flanges, and the cylinder head and nuts engaged with distal ends of the bolts. Further, the basal portion of the heat shielding member is preferably arranged between the flanges and the nuts and extends over all the flanges.

If multiple flanges are formed as an integral body in an exhaust manifold, the flanges may deteriorate due to concentrated stress caused at the time when the flanges are heated through operation of the internal combustion engine and thus are thermally deformed.

To avoid this problem, in the above-described configuration, the flanges of the branch pipes are separate from one another in the exhaust manifold to tolerate thermal deformation of the flanges. This makes it unlikely that the flanges will receive the concentrated stress, thus effectively decreasing deterioration of the flanges.

When the separate flanges are employed as in the above-described case, the problem described below may occur. That is, as the flanges thermally extend or contract, rotation torque may be transmitted to the nuts fastening the flanges, thus loosening the nuts.

To avoid this problem, in the above-described configuration, the basal portion of the heat shielding member is arranged between the flanges of the exhaust manifold and the nuts and extends over all the flanges. The heat shielding member thus blocks transmission of the rotation torque from the flanges to the nuts. This effectively makes it unlikely that the nuts will be loosened through thermal deformation of the flanges of the exhaust manifold.

In this case, the basal portion of the heat shielding member is preferably folded between the nuts and the flanges.

In this configuration, the basal portion of the heat shielding member is folded between the nuts and the flanges. Air layers having low heat conductivity compared with metal are formed between each adjacent pair of facing portions of the folded portion. The air layers decrease the heat transmitted from the exhaust manifold to the nuts. This lowers the heat resistance performance required for the nuts.

In addition, the basal portion of the heat shielding member preferably has a facing surface facing the flanges and/or the nuts, and a material having a lower friction resistance than that of the material forming the heat shielding member is preferably applied onto the facing surface.

If the low-friction material is applied onto the flange-facing surface of the basal portion of the heat shielding member in this configuration, each flange slides on the basal portion of the heat shielding member when the flanges are heated and thermally deformed. This effectively restricts the basal portion of the heat shielding member from following thermal deformation of each flange. Correspondingly, the nuts are restricted from following thermal deformation of the branch pipes of the exhaust manifold. Alternatively, the low-friction material may be applied onto the nut-facing surface of the basal portion of the heat shielding member. In this case, even if the exhaust manifold is heated to thermally deform the branch pipes, and the basal portion of the heat shielding member follows deformation of the branch pipes, the nuts are restricted from following deformation of the basal portion of the heat shielding member. As a result, loosening of the nuts is further effectively made unlikely to happen.

A sliding member onto which a material having a lower friction resistance than that of the material forming the heat shielding member is applied is preferably arranged between the basal portion of the heat shielding member and the flanges and/or between the basal portion of the heat shielding member and the nuts.

If the sliding member is mounted between the basal portion of the heat shielding member and the flanges in this configuration, the flanges slide on the sliding member when the flanges are heated and thermally deformed. This effectively restricts the basal portion of the heat shielding member from following deformation of the flanges. Correspondingly, the nuts are restricted from following thermal deformation of the branch pipes of the exhaust manifold. Alternatively, the sliding member may be arranged between the basal portion of the heat shielding member and the nuts. In this case, even if the exhaust manifold is heated to thermally deform the branch pipes and the basal portion of the heat shielding member follows deformation of the branch pipes, the nuts are restricted from following deformation of the basal portion of the heat shielding member. This further effectively makes it unlikely that the nuts will loosen.

In this case, the sliding member preferably has a U-shaped cross section and is arranged both between the basal portion of the heat shielding member and the flanges and between the basal portion of the heat shielding member and the nuts.

In this configuration, since the sliding member is arranged both between the basal portion of the heat shielding member and the flanges and between the basal portion of the heat shielding member and the nuts, the nuts are further effectively restricted from following thermal deformation of the branch pipes of the exhaust manifold. Also, since the sliding member is formed by the single component having a U-shaped cross section, the configuration of the sliding member is simplified. As a result, loosening of the nuts is further reliably made unlikely to happen through simple configuration.

MODES FOR CARRYING OUT THE INVENTION

A first embodiment of an exhaust system structure for an internal combustion engine according to the present invention will now be described with reference to FIGS. 1 and 2. The engine is an inline three-cylinder in the first embodiment.

Figure 1:
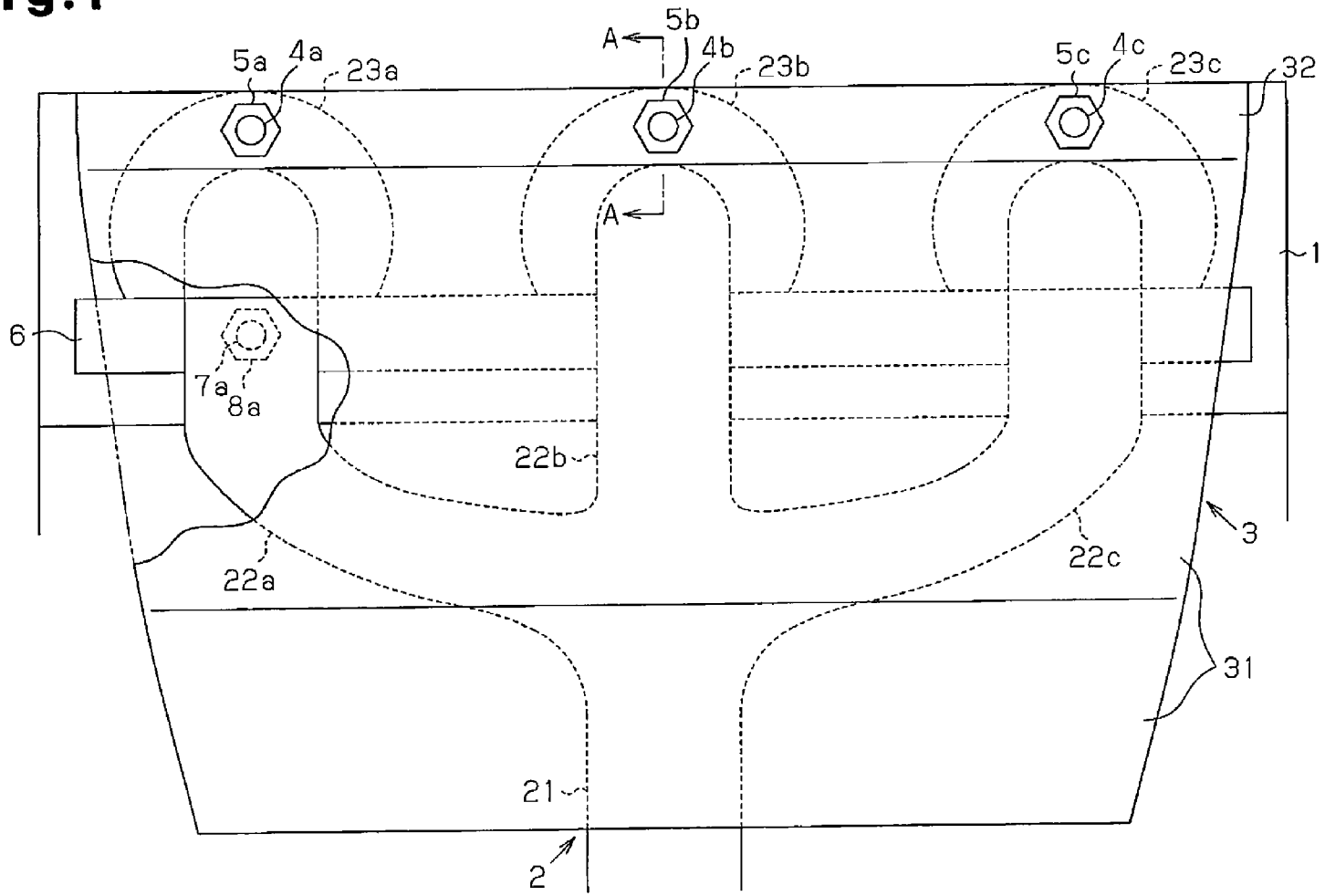
FIG. 1 is a plan view showing the configuration of an exhaust system structure for an internal combustion engine according to a first embodiment of the present invention with an exhaust manifold and a heat shielding member illustrated mainly.

As shown in FIG. 1, an exhaust system of an internal combustion engine includes an exhaust manifold 2 and a heat shielding member 3 for reducing heat damage caused by the exhaust manifold 2, which is a heat insulator.

The exhaust manifold 2 has branch pipes 22*a*, 22*b*, 22*c*, which are connected to the exhaust ports of the cylinders, and a collecting pipe 21, into which the branch pipes 22*a* to 22*c* converge. Flanges 23*a*, 23*b*, 23*c* are formed in the distal portion (in FIG. 1, the upper end portion) of the branch pipes 22*a* to 22*c*. The flanges 23*a* to 23*c* are arranged separately from one another. The exhaust manifold 2 is formed of cast steel.

The heat shielding member 3 is formed by pressing a metal plate and has a body 31 and a basal portion 32. The body 31 covers the exhaust manifold 2 and the basal portion 32 is fastened to a cylinder head 1. The basal portion 32 has an elongated shape and extends over all the flanges 23*a* to 23*c* at a position above the branch pipes 22*a* to 22*c*. The basal portion 32 is arranged closer to the viewer of FIG. 1 than the flanges 23*a* to 23*c*. The basal portion 32 of the heat shielding member 3 is fastened to the cylinder head 1 with fastening members (stud bolts 4*a*, 4*b*, 4*c* and nuts 5*a*, 5*b*, 5*c*), which are commonly used by the flanges 23*a* to 23*c*.

An elongated plate-like member 6 is mounted below the branch pipes 22*a* to 22*c*. The plate-like member 6 is formed by pressing a metal plate and extends over all the flanges 23*a* to 23*c*. The plate-like member 6 is arranged closer to the viewer of FIG. 1 than the flanges 23*a* to 23*c*. The plate-like member 6 is fastened to the cylinder head 1 with fastening members (a stud bolt 7*a* and a nut 8*a*), which are used commonly by the flanges 23*a* to 23*c*.

Figure 2:
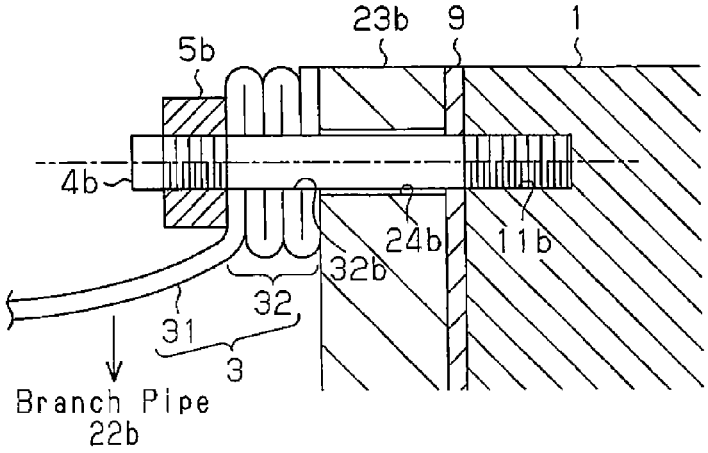
FIG. 2 is a cross-sectional view taken along line A-A of FIG. 1.

With reference to FIG. 2, the basal portion 32 of the heat shielding member 3 is arranged between the nut 5*b* and the flange 23*b* and folded several times (in this case, four times). Specifically, the basal portion 32 is folded such that the end of the basal portion 32 close to the nut 5*b* is located close to the branch pipe 22*b*, or arranged at a lower position as viewed in FIG. 2. A bolt hole 32*b*, a bolt hole 24*b*, and a bolt hole 11*b* are formed in the basal portion 32 of the heat shielding member 3, the flange 23*b*, and the cylinder head 1, respectively, to receive the stud bolt 4*b*. The nut 5*b* is engaged with a distal portion of the stud bolt 4*b*, as viewed to the left to the basal portion 32 in FIG. 2.

A gasket 9 is mounted between the cylinder head 1 and the flange 23*b*.

Operation of the first embodiment will hereafter be described.

The basal portion 32 of the heat shielding member 3 and the flanges 23*a* to 23*c* are fastened to the cylinder head 1 with the common fastening members (the stud bolts 4*a* to 4*c* and the nuts 5*a* to 5*c*). This arrangement decreases the number of the fastening members employed to fasten the exhaust manifold 2 and the heat shielding member 3, compared with, for example, the conventional configuration in which the flanges of the exhaust manifold are fastened to the cylinder head using fastening members and the heat shielding member is fastened to the exhaust manifold using fastening members separate from the aforementioned fastening members. This arrangement also makes it unnecessary for the exhaust manifold 2 to have holes specifically formed to fasten the heat shielding member 3 to the exhaust manifold 2.

In an exhaust manifold having integrated flanges of branch pipes, the flanges may deteriorate due to concentrated stress caused at the time when the flanges are heated through engine operation and thus would thermally deform.

However, in the first embodiment, since the flanges 23*a* to 23*c* of the exhaust manifold 2 are formed separately from one another, thermal deformation of the flanges 23*a* to 23*c* are tolerated. This makes it unlikely that the flanges 23*a* to 23*c* will receive the concentrated stress. Deterioration of the flanges 23*a* to 23*c* is thus effectively avoided.

However, when the flanges 23*a* to 23*c* are separate from one another as in the first embodiment, the problem described below may occur. That is, each of the flanges may thermally extend or contract such that rotation torque is transmitted to the nut fastening the flange, thus loosening the nut.

To avoid this problem, in the first embodiment, the basal portion 32 of the heat shielding member 3 is arranged between the flanges 23*a* to 23*c* and the nuts 5*a* to 5*c* and extended over all the flanges 23*a* to 23*c*. The heat shielding member 3 thus blocks transmission of rotation torque from the flanges 23*a* to 23*c* to the nuts 5*a* to 5*c*. As a result, loosening of the nuts 5*a* to 5*c* is effectively avoided.

The basal portion 32 of the heat shielding member 3 is folded between the nuts 5*a* to 5*c* and the flanges 23*a* to 23*c*. This arrangement forms a low heat conductive air layer between each adjacent pair of facing portions of the folded portions of the basal portion 32. These air layers decrease heat transmission from the exhaust manifold 2 to the nuts 5*a* to 5*c*.

The exhaust system structure for an internal combustion engine according to the first embodiment has the advantages (1), (2), and (3), which will be described below.

(1) The exhaust system structure for an internal combustion engine includes the exhaust manifold 2 and the plate-like heat shielding member 3. The exhaust manifold 2 includes the branch pipes 22*a* to 22*c* and the flanges 23*a* to 23*c*, which are formed at the distal portions of the branch pipes 22*a* to 22*c*. The heat shielding member 3 is mounted to cover the exhaust manifold 2 to decrease heat damage caused by the exhaust manifold 2. The basal portions 32 of the heat shielding member 3 and the flanges 23*a* to 23*c* are fastened to the cylinder head 1 using the common fastening members (the stud bolts 4*a* to 4*c* and the nuts 5*a* to 5*c*). This configuration decreases the number of the fastening members and makes it unnecessary for the exhaust manifold 2 to have holes specifically formed to fasten the heat shielding member 3 to the exhaust manifold 2. The fastening structure for the exhaust manifold 2 and the heat shielding member 3 is thus simplified.

(2) The flanges 23*a* to 23*c* of the branch pipes 22*a* to 22*c* are separate from one another. The fastening members (the stud bolts 4*a* to 4*c* and the nuts 5*a* to 5*c*) include the stud bolt 4*b* passed through the bolt holes 32*b*, 24*b*, and 11*b*, which are formed in the basal portion 32 of the heat shielding member 3, the flanges 23*a* to 23*c*, and the cylinder head 1, and the nut 5*b* engaged with the distal end of the stud bolt 4*b*. The basal portion 32 of the heat shielding member 3 is arranged between the flanges 23*a* to 23*c* and the nuts 5*a* to 5*c* and extended over all the flanges 23*a* to 23*c*. This arrangement effectively decreases loosening of the nuts 5*a* to 5*c*, which is caused through thermal deformation of the corresponding flanges 23*a* to 23*c* of the exhaust manifold 2.

(3) The basal portion 32 of the heat shielding member 3 is folded between the nuts 5*a* to 5*c* and the flanges 23*a* to 23*c*. This decreases the heat resistance performance required for the nuts 5*a* to 5*c*.

A second embodiment of the present invention will hereafter be described with reference to FIGS. 3 and 4.

The second embodiment is different from the first embodiment in that a heat shielding member is covered by a sliding member having a U-shaped cross section.

The description below is focused on the difference between the second embodiment and the first embodiment. The configurations of the components of the second embodiment other than a heat shielding member 103 and a sliding member 135 are identical to the configurations of the corresponding components of the first embodiment. Common reference numerals are thus given to those components and description thereof is not repeated hereinafter.

Figure 3:
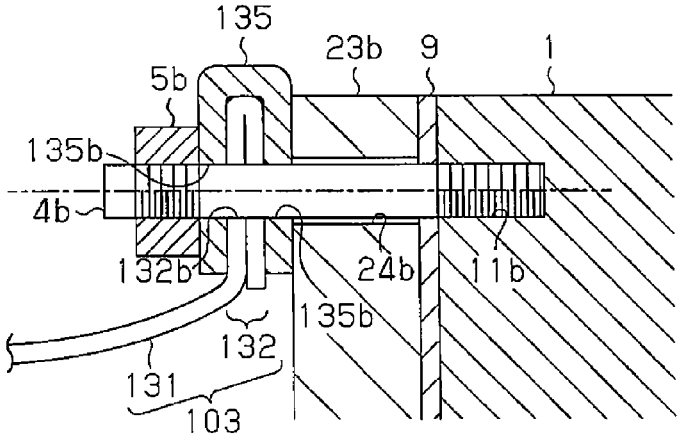
FIG. 3 is a cross-sectional view corresponding to FIG. 2, illustrating an exhaust system structure for an internal combustion engine according to a second embodiment of the invention.
Figure 4:
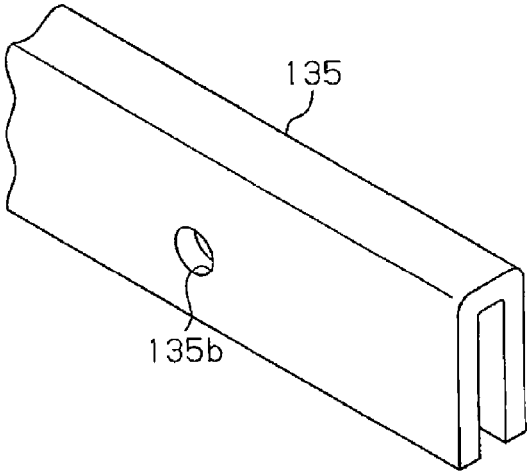
FIG. 4 is a perspective view showing a sliding member of the second embodiment.

With reference to FIGS. 3 and 4, the sliding member 135 is formed by pressing a metal plate in an elongated shape having a U-shaped cross section. Material having low friction resistance compared with the material forming the heat shielding member 103 is applied onto the surface of the sliding member 135. Bolt holes 135*b*, through which the stud bolt 4*b* is passed, are formed in the sliding member 135. One of the bolt holes 135*b* is located between the basal portion 132 of the heat shielding member 103 and the flange 23*b* and another one of the bolt holes 135*b* is arranged between the basal portion 132 and the nut 5*b*.

Operation of the second embodiment will hereafter be described.

The sliding member 135 is mounted between the basal portion 132 of the heat shielding member 103 and the flanges 23*a* to 23*c*. The flanges 23*a* to 23*c* thus slide on the sliding member 135 when heated and thermally deformed. This effectively restricts the basal portion 132 of the heat shielding member 103 from following thermal deformation of the flanges 23*a* to 23*c*.

The sliding member 135 is mounted between the basal portion 132 of the heat shielding member 103 and the nut 5*b*. This effectively restricts the nuts 5*a* to 5*c* from following deformation of the basal portion 132 of the heat shielding member 103, which may happen in a manner following thermal deformation of the flanges 23*a* to 23*c*.

The exhaust system structure for an internal combustion engine according to the second embodiment has the advantage (4), which will be described below, in addition to the advantages (1) to (3) of the first embodiment.

(4) The sliding member 135, onto which the material with lower friction resistance than the material of the heat shielding member 103 is applied, is arranged both between the basal portion 132 of the heat shielding member 103 and the flange 23*b* and between the basal portion 132 and the nut 5*b*. The sliding member 135 has a U-shaped cross section. This arrangement further effectively decreases loosening of the nuts 5*a* to 5*c* caused by thermal deformation of the flanges 23*a* to 23*c* of the exhaust manifold 2. The arrangement also allows the sliding member 135 to be formed by a single component.

The exhaust system structure for an internal combustion engine according to the present invention is not restricted to the configurations of the illustrated embodiments but may be embodied in, for example, the modified forms described below.

If a sliding member 135 having a U-shaped cross section is employed as in the case of the second embodiment, the sliding member 135 may be formed by the single component arranged between the basal portion 132 of the heat shielding member 103 and the flange 23*b* and between the basal portion 132 and the nut 5*b*. However, the configuration of the sliding member according to the present invention is not restricted to the configuration of the second embodiment. That is, a sliding member mounted between the basal portion 132 of the heat shielding member 103 and the flange 23*b* may be employed separately from a sliding member arranged between the basal portion 132 and the nut 5*b*.

In the second embodiment and its modified form described above, an integral sliding member is or separate sliding members are mounted both between the basal portion 132 of the heat shielding member 103 and the flange 23*b* and between the basal portion 132 and the nut 5*b*. This arrangement is preferable to reliably decrease loosening of the nuts 5*a* to 5*c* caused by thermal deformation of the flanges 23*a* to 23*c* of the exhaust manifold 2. However, the present invention is not restricted to such arrangement. That is, a sliding member may be arranged between only between the basal portion of the heat shielding member and the flange or between the basal portion of the heat shielding member and the nut. This configuration reduces the size of the sliding member, thus decreasing the weight.

In the first embodiment, material having low friction resistance compared with the material of the basal portion 32 of the heat shielding member 3 may be applied onto a surface of the basal portion 32 of the heat shielding member 3. Specifically, the material with low friction resistance may be applied onto the surface of the basal portion of the heat shielding member facing the flanges, for example. In this case, the flanges slide on the basal portion when the flanges are heated and thermally deformed. This configuration effectively restricts the basal portion of the heat shielding member from following thermal deformation of the flanges. The configuration also restricts the nuts from following thermal deformation of the branch pipes of the exhaust manifold. Alternatively, the material with low friction resistance may be applied onto the surface of the basal portion of the heat shielding member facing the nuts. This arrangement effectively restricts the nuts from following deformation of the basal portion of the heat shielding member, which occurs in a manner following thermal deformation of the branch pipes caused by heating of the exhaust manifold. Loosening of the nuts is thus further effectively decreased.

In each of the illustrated embodiments, the basal portion 32, 132 of the heat shielding member 3, 103 is folded between the nuts 5*a* to 5*c* and the flanges 23*a* to 23*c*. Air layers are thus formed between each adjacent pair of facing portions of the folded portion of the basal portion 32, 132. This configuration is preferable to decrease heat transmission from the flanges 23*a* to 23*c* to the nuts 5*a* to 5*c* by means of the air layers. However, the present invention is not restricted to this configuration. That is, if nuts having high heat resistance performance are used, the basal portion does not necessarily have to be folded. Alternatively, a heat insulating material separate from the basal portion of the heat shielding member may be mounted between at least one of a position between the basal portion and the flanges and a position between the basal portion and the nuts.

In each of the illustrated embodiments, the basal portion 32, 132 of the heat shielding member 3, 103 extends over all the flanges 23*a* to 23*c*. However, the basal portion of the heat shielding member may be divided into basal portions each corresponding to one of the flanges 23*a* to 23*c*. In this case, the plate-like member 6 illustrated in FIG. 1 must be mounted between the nuts and the basal portions of the heat shielding member or between the basal portions and the flanges.

In the illustrated embodiments, the flanges 23*a* to 23*c* of the exhaust manifold 2 are separate from one another. However, the exhaust manifold according to the present invention is not restricted to this configuration. That is, the exhaust manifold may include an integral body of flanges formed on distal portions of corresponding branch pipes.

Description of the Reference Numerals

1 . . . cylinder head, 11*b* . . . bolt hole, 2 . . . exhaust manifold, 21 . . . collecting pipe, 22*a* to 22*c* . . . branch pipe, 23*a* to 23*c* . . . flange, 3, 103 . . . heat shielding member, 31, 131 . . . body, 32, 132 . . . basal portion, 32*b*, 132*b* . . . bolt hole, 4*a* to 4*c* . . . stud bolt, 5*a* to 5*c* . . . nut, 6 . . . plate-like member, 7*a* . . . stud bolt, 8*a* . . . nut, 9 . . . gasket, 135 . . . sliding member, 135*b* . . . bolt hole

The invention claimed is:

1. An exhaust system structure for an internal combustion engine, the engine including a cylinder head having bolt holes, the structure comprising:

an exhaust manifold including a plurality of branch pipes and flanges each formed on a distal portion of one of the branch pipes, the flanges of the branch pipes being separate from one another and each having a bolt hole;

a plate-like heat shielding member covering the exhaust manifold to suppress occurrence of heat damage caused by the exhaust manifold, the heat shielding member including a basal portion having bolt holes; and a common fastening member to fasten the basal portion of the heat shielding member and the flanges to the cylinder head of the engine, the fastening member including bolts passed through the bolt holes in each of the basal portion of the heat shielding member, the flanges, and the cylinder head and including nuts engaged with distal ends of the bolts, wherein the basal portion of the heat shielding member is folded between the flanges and the nuts and extends over all the flanges.

2. The exhaust system structure for an internal combustion engine according to claim 1, further comprising:

a facing surface on the basal portion of the heat shielding member that faces the flanges and/or the nuts; and a material applied onto the facing surface that has a lower friction resistance than that of the material forming the heat shielding member.

3. The exhaust system structure for an internal combustion engine according to claim 1, further comprising:

a sliding member arranged between the basal portion of the heat shielding member and the flanges and/or between the basal portion of the heat shielding member and the nuts; and a material applied onto the sliding member that has a lower friction resistance than that of the material forming the heat shielding member.

4. The exhaust system structure for an internal combustion engine according to claim 3, wherein the sliding member has a U-shaped cross section and is arranged both between the basal portion of the heat shielding member and the flanges and between the basal portion of the heat shielding member and the nuts.

5. An exhaust system structure for an internal combustion engine, the engine including a cylinder head having bolt holes, the structure comprising:

an exhaust manifold including a plurality of branch pipes and flanges each formed on a distal portion of one of the branch pipes, the flanges of the branch pipes being separate from one another and each having a bolt hole;

a plate-like heat shielding member covering the exhaust manifold to suppress occurrence of heat damage caused by the exhaust manifold, the heat shielding member including a basal portion having bolt holes;

a common fastening member to fasten the basal portion of the heat shielding member and the flanges to the cylinder head of the engine, the fastening member including bolts passed through the bolt holes formed in each of the basal portion of the heat shielding member, the flanges, and the cylinder head and including nuts engaged with distal ends of the bolts, wherein the basal portion of the heat shielding member is arranged between the flanges and the nuts and extends over all the flanges;

a sliding member that has a U-shaped cross section is arranged both between the basal portion of the heat shielding member and the flanges and between the basal portion of the heat shielding member and the nuts; and a material applied onto the sliding member that has a lower friction resistance than that of the material forming the heat shielding member.

* * * * *